US005632515A

United States Patent [19]

Dowling

[11] Patent Number: 5,632,515

[45] Date of Patent: May 27, 1997

[54] LATCH DEVICE FOR USE WITH A VEHICLE TRUNK LID

[75] Inventor: Patrick J. Dowling, Yamanashi-ken, Japan

[73] Assignee: Mitsui Kinzoku Kogyo Kabusiki Kaisha, Tokyo, Japan

[21] Appl. No.: 357,225

[22] Filed: Dec. 12, 1994

[30] Foreign Application Priority Data

Dec. 13, 1993 [JP] Japan ..... 5-341852

[51] Int. Cl.[6] ..... E05L 3/16

[52] U.S. Cl. ..... 292/216; 292/DIG. 43; 292/DIG. 23; 292/341.16

[58] Field of Search ..... 292/216, DIG. 43, 292/DIG. 23, DIG. 27, 341.16

[56] References Cited

U.S. PATENT DOCUMENTS

| | | | |
|---|---|---|---|
| 4,518,180 | 5/1985 | Kleefeldt et al. | 292/201 |
| 4,569,544 | 2/1986 | Escaravage | 292/216 |
| 4,588,217 | 5/1986 | Escaravage | 292/201 |
| 4,624,491 | 11/1986 | Vincent | 292/201 |
| 4,763,936 | 8/1988 | Rogakos et al. | 292/201 |
| 4,948,183 | 8/1990 | Yamada | 292/199 |
| 4,962,955 | 10/1990 | Ferrara et al. | 292/216 |
| 4,978,153 | 12/1990 | Hirsch et al. | 292/201 |
| 4,998,758 | 3/1991 | Kowalczyk et al. | 292/201 |
| 5,020,838 | 6/1991 | Fukumoto | 292/201 |
| 5,074,603 | 12/1991 | Brackmann | 292/216 |
| 5,232,253 | 8/1993 | Tamiya | 292/201 |
| 5,273,324 | 12/1993 | Kobayashi | 292/201 |
| 5,411,302 | 5/1995 | Shimada | 292/201 |

FOREIGN PATENT DOCUMENTS 3-58571 6/1991 Japan .

*Primary Examiner*—Steven N. Meyers
*Assistant Examiner*—Donald J. Lecher
*Attorney, Agent, or Firm*—Browdy and Neimark

[57] ABSTRACT

A latch device for use with a vehicle trunk lid comprises a base plate and an actuator unit mounted on the base plate. The base plate has a latch adapted to engage with a striker and a ratchet arranged to engage with the latch for maintaining engagement between the latch and the striker. The actuator unit has a motor, an output gear turned by means of the motor, a cam lever connected to the output gear with a lost motion coupling and a connection shaft which rotates together with the cam lever as one body. The cam lever is adapted to make the ratchet leave the latch when turned. The latch device further has an open lever engaged with a rod leading to a key cylinder of a trunk. The open lever is secured on the connection shaft. The connection shaft and the cam lever are formed from synthetic resin in such a manner to be integral with each other.

5 Claims, 4 Drawing Sheets

LATCH DEVICE FOR USE WITH A VEHICLE TRUNK LID

FILED OF THE INVENTION

The present invention relates to a latch device for use with a vehicle trunk lid.

DESCRIPTION OF THE PRIOR ART

The Japanese Utility Model Application Laid-Open No. HEI 3-58571 describes a prior art latch device for use with a trunk lid, as illustrated in FIGS. 7 and 8, which has a base plate A, a latch C engaged with a striker B, a ratchet D for preventing the reverse rotation of the latch C, an output member F rotated by a motor E, a cam member G mounted on a shaft, around which the output member F rotates, and a rod H connected to a key cylinder (not shown) of the trunk. When the cam member G turns or when the rod H moves to the right, as viewed in these figure, the ratchet D leaves the latch C and thus releases the engagement between the latch C and the striker B.

The prior art device described hereinabove is efficient and excellent in releasing the latch C with the aid of the force of the motor. However, the prior art device still has room for improvement of the connection between the trunk key cylinder and the ratchet D. Namely, the prior art device has a defect in that though the key cylinder can be connected with the ratchet D by means of the single rod H when the key cylinder is placed at the right or left side of the base plate A, the key cylinder can not be connected with the ratchet D by means of the single rod H when the key cylinder is located above or below the base plate A.

As a countermeasure against this, there has been proposed an improved latch device, as shown in FIG. 9 in which an open lever J engaged with the rod H is mounted on the base plate A. In the case of this improved device, the open lever J can be easily connected with the key cylinder by means of the rod H by changing the shape of the open lever J regardless of the relative position of the key cylinder with respect to the base plate A.

This improved device, however, has a drawback in that it is sometimes difficult to attach this device to a vehicle body because the longitudinal size or length of the base plate becomes large as a result of mounting the open lever J thereto.

The present invention is accomplished to eliminate the drawback of the prior art device.

SUMMARY OF THE INVENTION

Accordingly, an object of the present invention is to provide a latch device for use with a trunk lid, which can facilitate the connection between the trunk key cylinder and the ratchet and can be formed in such a manner to become small in size.

Other features, objects and advantages of the present invention will become apparent from the following description of a preferred embodiment with reference to the drawings in which like reference characters designate like or corresponding parts throughout several views

DETAILED DESCRIPTION OF THE PREFERRED EMBODIMENT

Hereinafter, the preferred embodiment of the present invention, namely, a latch device embodying the present invention will be described in detail by referring to the accompanying drawings.

Figure 1:
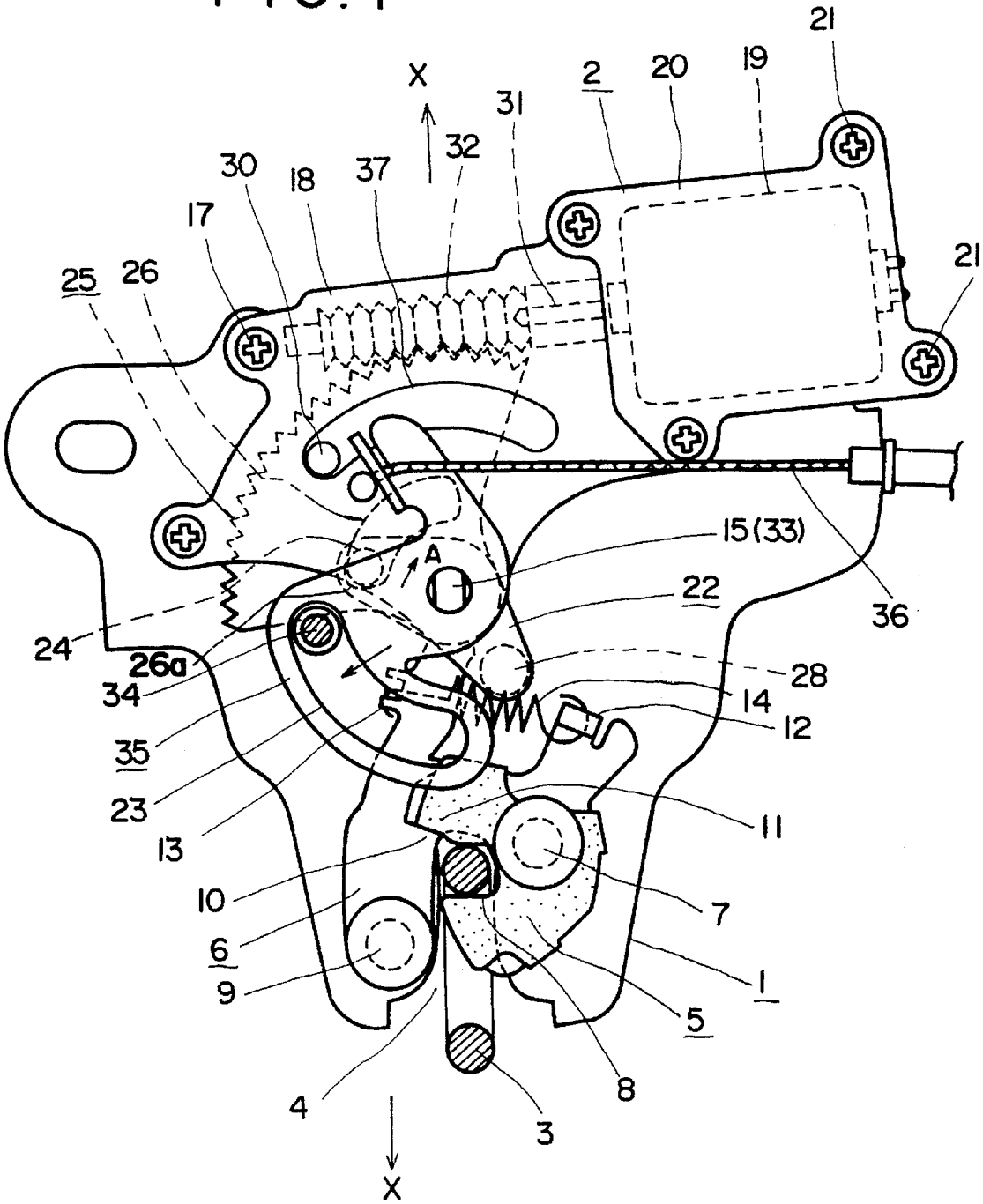
FIG. 1 is a plan view of a latch device according to the present invention.

As shown in FIG. 1, a latch device of the present invention has a base plate 1 fastened to one of a trunk lid and a vehicle body with bolts (not shown) and a striker 3 fixed to the other thereof. In the bottom portion of the base plate 1, a groove 4 which the striker 3 enters is formed. As viewed in FIG. 1, at the right side of the groove 4, a latch 5 engaged with the striker 3 is rotatably supported on a latch shaft 7. Further, at the left side of the groove 4, a ratchet 6 engaged with the latch 5 for maintaining the engagement between the latch 5 and the striker 3 is rotatably supported on a ratchet shaft 9.

Moreover, a spring 14 is provided between a projection 12 of the latch 5 and a projection 13 of the ratchet 6. When the striker 3 engages with a U-shaped groove 8 of the latch 5, the latch 5 turns clockwise against the elasticity of the spring 14. Subsequently, a pawl portion 10 of the ratchet 6 is engaged with a stage portion 11 of the latch 5 by the action of the elasticity of the spring 14. Thus the latch 5 is prevented from reversing.

Figure 2:
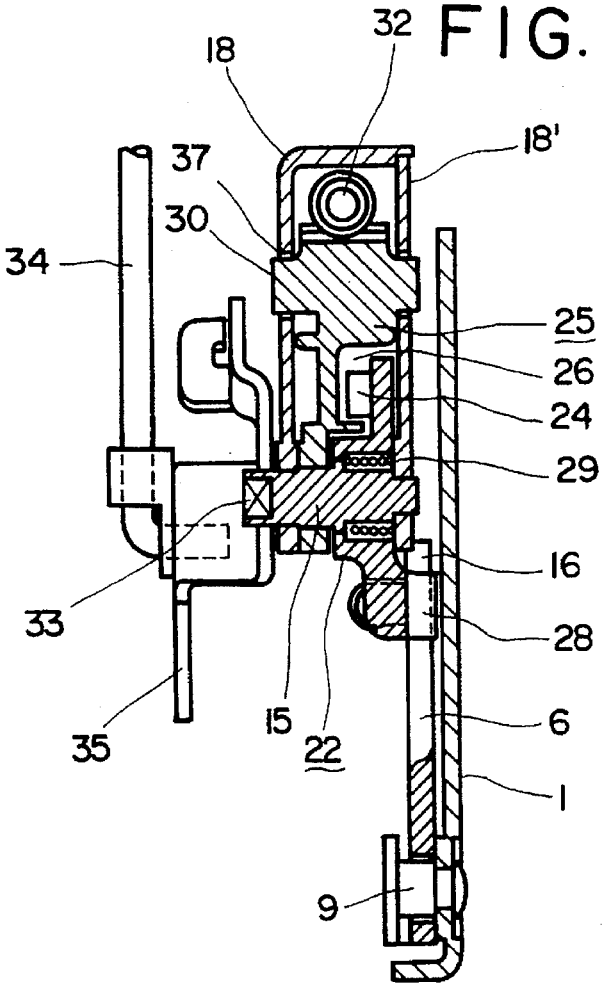
FIG. 2 is a sectional view of the latch device, taken on line X—X of FIG. 1.
Figure 3:
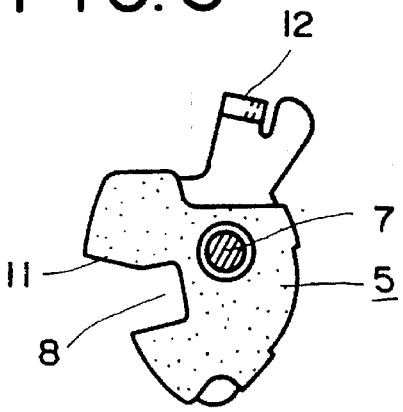
FIG. 3 is a plan view of a latch of FIG. 1.
Figure 4:
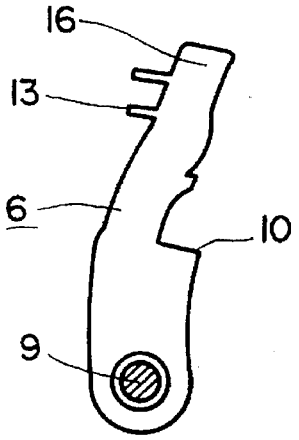
FIG. 4 is a plan view of a ratchet of FIG. 1.
Figure 5:
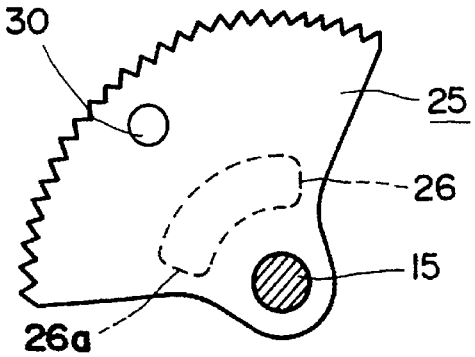
FIG. 5 is a plan view of an output gear of FIG. 1.

To the top portion of the base plate 1, an actuator unit 2 is secured by screws 17. The unit 2 has unit housing members 18 and 18' to which a case 20 for a motor 19 is secured by screws 21. As illustrated in FIG. 2, the housing members 18 and 18' is shaped like an inverted U. In the inside of the members, a screw shaft 32 fixed to a drive shaft 31 of the motor 19, a sector type output gear 25 meshing with the screw shaft 32 and a boomerang-like cam lever 22 and so on are provided.

Figure 6:
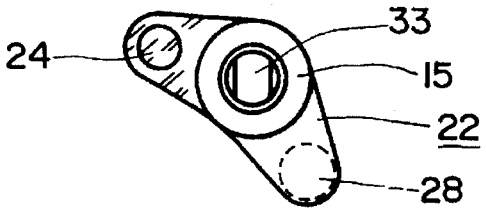
FIG. 6 is a plan view of a cam lever of FIG. 1.
Figure 7:
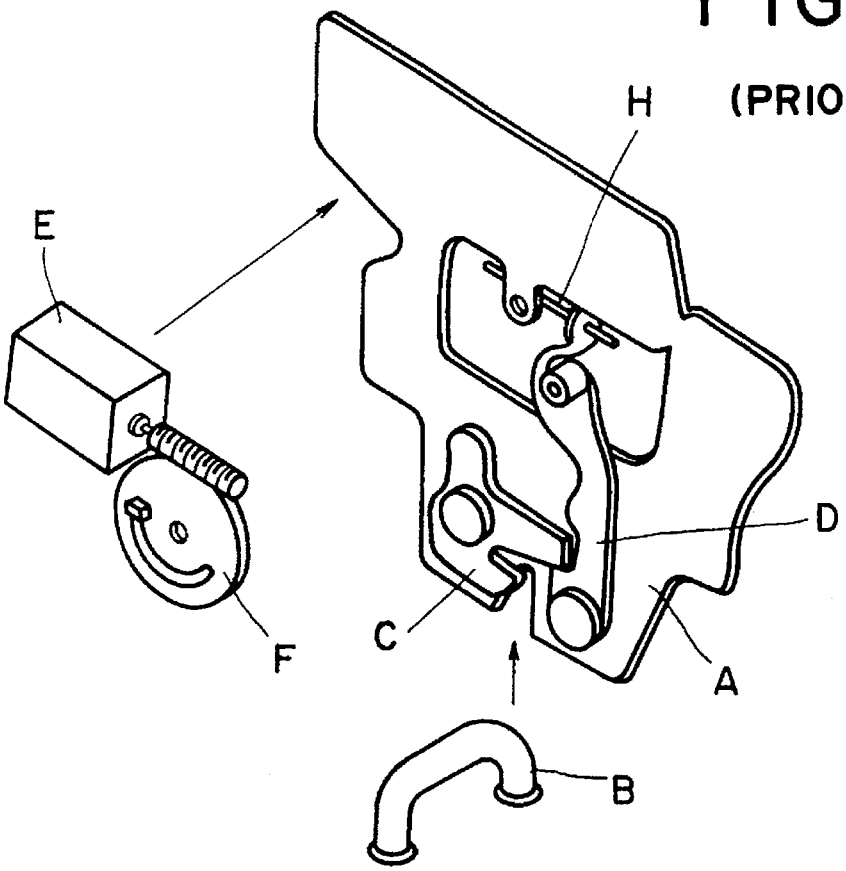
FIG. 7 (PRIOR ART)
FIGS. 7 and 8 are diagrams for illustrating a first example of the publicly known prior art device.
Figure 8:
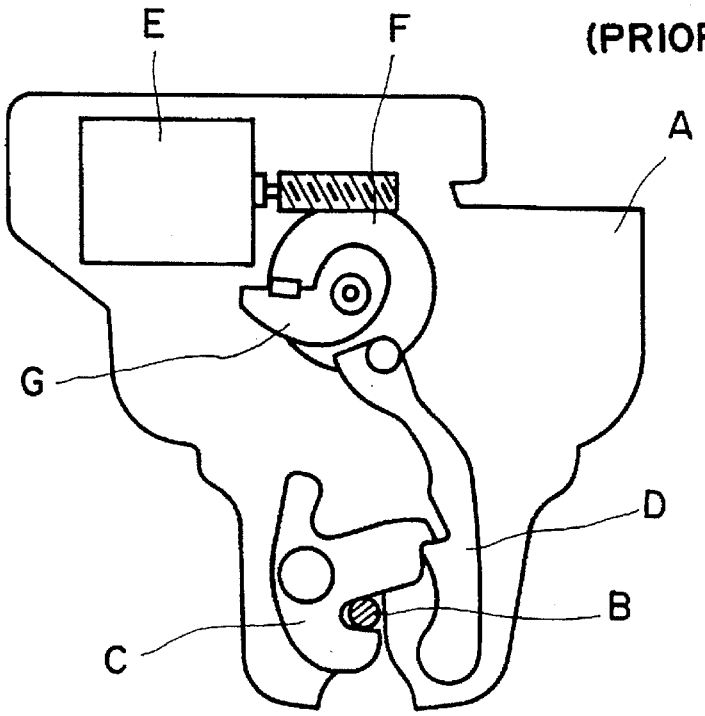
FIG. 8 (PRIOR ART)
Figure 9:
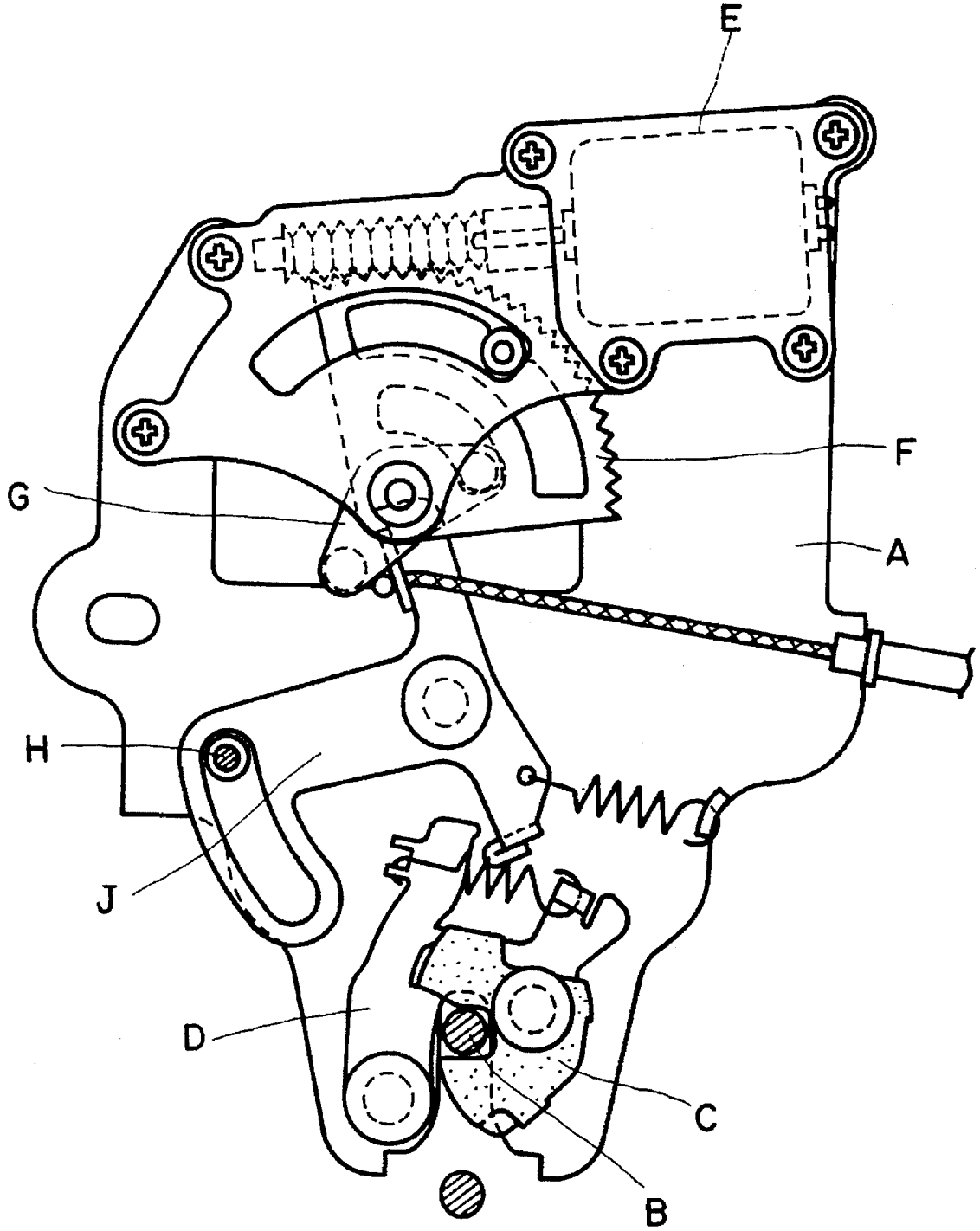
FIG.9 (PRIOR ART)
FIG. 9 is a diagram for illustrating a second example of the publicly known prior art device.

As shown in FIGS. 2 and 6, a center shaft (or connection shaft) 15 is formed in the central portion of the cam lever 22. Preferably, the shaft 15 and the lever 22 are formed from synthetic resin in such a manner to be integral with each other. Further, both of the ends of the shaft 15 are rotatably inserted into shaft holes formed in the housing members 18 and 18', respectively. As shown in FIG. 2, a square pillar shaft portion 33 of the shaft 15 protrudes from the housing member 18 outwardly. Moreover, an open lever 35 is fixed to this protrusion portion 33. As will be described later, the open lever 35 is turned by manipulating a trunk key cylinder and a manual release lever provided near the driver's seat.

The output gear 25 is rotatably supported on the connection shaft 15. The output gear 25 has a projection 30 which engages with a circular arc slot 37 bored in the housing member 18. The engagement between the projection 30 and the arc slot 37 restricts the range of rotation of the gear 25. Further, a circular arc slot 26 is formed in the gear 25 along an arc of a circle centered at the center of the transverse section of the shaft 15. A pin 24 formed at an end of the cam lever 22 engages with the circular arc slot 26 with a lost motion coupling. The cam lever 22 is urged by a spring 29 owing to the elasticity thereof in the opposite direction to arrow A in FIG. 1 and is at a standstill in a state in which the pin 24 is brought into contact with a left wall 26*a* of the circular arc slot 26 of gear 25 as shown in this figure.

When the cam lever 22 is turned in the direction indicated by the arrow A by turning the open lever 35 or by the rotation of the motor 19, a pin 28 formed at the other end of the cam lever 22 engages with an end portion 16 of the ratchet 6. Thus the ratchet 6 turns counterclockwise against the elasticity of the spring 14 to release the latch 5.

Moreover, a circular arc slot 23 formed along an arc of a circle centered at the center of the transverse section of the shaft 15 is provided in the open lever 35. The slot 23 is engaged with an end portion of a rod 34 leading to the trunk key cylinder (not shown) with a lost motion coupling. If the trunk lid should be opened as a result of an operation performed in the inside of the vehicle, the open lever 35 is engaged with an end of a wire cable 36 leading to the release lever (not shown).

Hereinafter, an operation of this embodiment will be described by referring to the drawings.

When the striker 3 comes into contact with the U-shaped groove 8 of the latch 5 by closing the trunk lid, the latch 5 turns clockwise against the elasticity of the spring 14. Subsequently, the pawl portion 10 of the ratchet 6 is engaged with the stage portion 11 of the latch 5 by the elasticity of the spring 14. Thus the engagement between the latch 5 and the striker 3 is maintained (see FIG. 1).

In the case where the trunk lid is opened by means of the motor 19, a switch (not shown) provided near the driver's seat is pushed to cause the motor 19 to turn the output gear 25 in the direction indicated by the arrow A. Then, the pin 24 of the cam lever 22 is pushed by the left wall 26*a* of the arc slot 26 bored in the gear 25 and further the cam lever 22 turns. Thus the pin 28 of the cam lever 22 is brought into abutting engagement with the end portion 16 of the ratchet 6, so that the ratchet 6 is turned counter-clockwise against the elasticity of the spring 14. Thereby, the ratchet 6 leaves the latch 5 and further the engagement between the latch 5 and the striker 3 is released. Consequently, the trunk lid is opened. Incidentally, if the cam lever 22 is turned by means of the motor 19, the open lever 35 turns simultaneously. The rod 34, however, does not moves owing to the lost motion coupling between the slot 23 and the rod 34.

In the case where the trunk lid is opened by means of a trunk key cylinder or of the manual release lever (not shown) provided near the driver's seat, the open lever 35 is turned in the direction indicated by the arrow A through the rod 34 or the wire cable 36. Then, the cam lever 22 connected to the open lever 35 through the connection shaft 15 also turns in the direction indicated by the arrow A. Thus the pin 28 of the cam lever 22 is brought into abutting engagement with the ratchet 6 to make the ratchet 6 turn counterclockwise. Thereby, the ratchet 6 leaves the latch 5 and further the engagement between the latch 5 and the striker 3 is released. Consequently, the trunk lid is opened.

As described above, in the case of the device of the present invention, the open lever 35 connected to the trunk key cylinder is fixed to the rotation axis or shaft 15 of the cam lever 22. Thus space for providing the open lever 35 can be saved. Consequently, the present invention can prevent the latch device from becoming large in size.

Although the preferred embodiment of the present invention has been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A latch device for use with a vehicle trunk lid, comprising:

a latch adapted to engage with a striker;

a ratchet arranged to engage with the latch for maintaining engagement between the latch and striker;

a cam lever adapted to release the ratchet from the latch;

an output gear for rotating the cam lever when turned by means of a motor;

an open lever connected to a trunk key cylinder; and a connection shaft supporting the cam lever, the output gear and the open lever wherein said cam lever and said open lever are secured to the connection shaft; and said output gear is rotatably mounted to the connection shaft.

2. A latch device according to claim 1, wherein the connection shaft and the cam lever are formed from synthetic resin in such a manner to be integral with each other.

3. A latch device according to claim 1, wherein a wire cable leading to a manual release lever provided near a driver's seat is connected to the open lever.

4. A latch device for use with a vehicle trunk lid, comprising:

a base plate having a latch adapted to engage with a striker and a ratchet arranged to engage with the latch for maintaining engagement between the latch and the striker;

an actuator unit mounted on the base plate and having a motor, an output gear turned by means of the motor, a cam lever connected to the output gear with a lost motion coupling and a connection shaft which rotates together with the cam lever as one body, said cam lever being adapted to release the ratchet from the latch when turned, said output gear being rotatably mounted to the connection shaft; and an open lever engaged with a rod leading to a key cylinder of a trunk, wherein the open lever is secured on the connection shaft.

5. A latch device according to claim 4, wherein the connection shaft and the cam lever are formed from synthetic resin in such a manner to be integral with each other.

* * * * *